US005637369A

United States Patent [19]

Stewart

[11] Patent Number: 5,637,369

[45] **Date of Patent: *Jun. 10, 1997**

[54] BUSINESS FORM WITH REMOVABLE LABEL AND METHOD FOR PRODUCING THE SAME WITH LABEL STOCK

[76] Inventor: Gary E. Stewart, 4205 E. Desert Crest, Paradise Valley, Ariz. 85253

[ * ] Notice: The term of this patent shall not extend beyond the expiration date of Pat. No. 5,482,328.

[21] Appl. No.: 408,887

[22] Filed: Mar. 24, 1995

Related U.S. Application Data

[63] Continuation-in-part of Ser. No. 246,966, May 20, 1994, Pat. No. 5,482,328.

[51] Int. Cl.[6] ..... G09F 3/10

[52] U.S. Cl. ..... 428/42.3; 283/81; 428/43; 462/2

[58] Field of Search ..... 428/42, 41, 40, 428/43; 283/81; 462/2

[56] References Cited

U.S. PATENT DOCUMENTS 4,379,573 4/1983 Lomeli et al. ..... 428/42

*Primary Examiner*—Alexander Thomas
*Attorney, Agent, or Firm*—Tod R. Nissle, P.C.

[57] ABSTRACT

A business form includes a card produced by adhering conventional label stock to the back of the form, by die cutting completely through the form and partially through the label stock to produce a laminate which can be peeled from the business form, and by peeling the laminate from the business form and folding the laminate to form the card.

3 Claims, 5 Drawing Sheets

FIG. 1
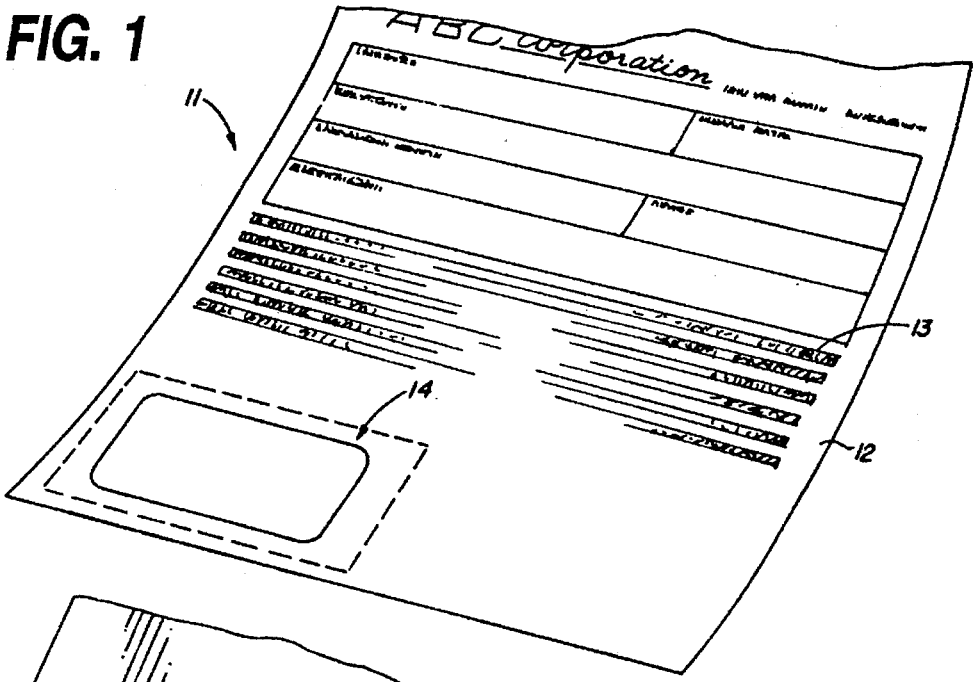
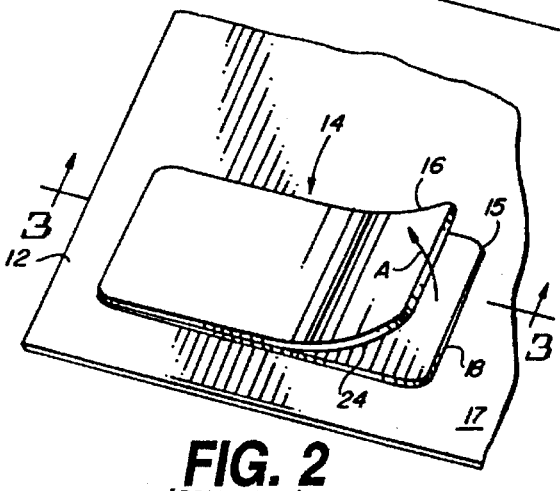
FIG. 2
(PRIOR ART)
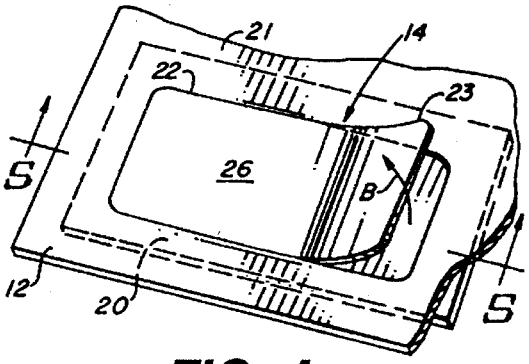
FIG. 4
(PRIOR ART)
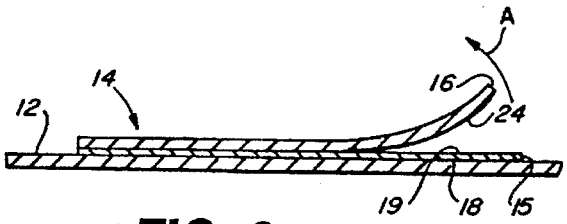
FIG. 3
(PRIOR ART)
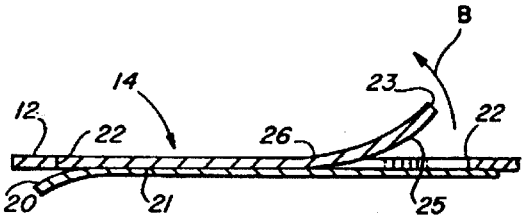
FIG. 5
(PRIOR ART)

BUSINESS FORM WITH REMOVABLE LABEL AND METHOD FOR PRODUCING THE SAME WITH LABEL STOCK

This is a continuation-in-part of application Ser. No. 08/246,966, filed May 20, 1994, for "BUSINESS FORM WITH REMOVABLE LABEL AND METHOD FOR PRODUCING THE SAME WITH LABEL STOCK", now U.S. Pat. No. 5,482,328.

BACKGROUND OF THE INVENTION.

1. Field of the Invention

This invention relates to business forms having die cut label areas which are removable therefrom and to a method for producing the same.

More particularly, the invention pertains to a business form which includes an imprinted paper substrate having label stock affixed thereto, the label stock including a layer of face stock permanently adhesively secured to the back of the substrate and a liner layer adhesively secured to the back of the face stock layer such when the liner layer is peeled off of the face stock layer, a layer of adhesive remains affixed to the back of the face stock layer.

In a further respect, the invention pertains to a business form of the type described which includes a multilayer removable die cut area which extends through the paper substrate and the face stock layer such that the die cut area can be peeled off of the liner layer and removed from the business form.

2. Description of the Prior Art

As described in my U.S. Pat. No. 4,379,573, providing business forms with removable labels is a widespread practice. Such labels are often imprinted with information which, when combined with the ability to transfer the label, facilitates the completion of a particular business transaction. For instance, a label may be imprinted with the name and address of the company from which the business form originated so that a customer can remove the label from the form and then attach the label to an envelope containing an order being forwarded to the company. Likewise, the label may be imprinted with information identifying the customer so that when the label is attached to an order form processing of the order by the company is expedited.

These so-called "transfer labels" are actually comprised of two layers of material. The first or lower layer has a pressure sensitive adhesive on its bottom surface and an adhesive on its upper surface which detachably secures the second layer—a paper label—thereto. Transfer labels are normally applied to business forms by feeding the forms into a label air machine which blows the transfer labels from a strip of carrier material toward the forms so that the pressure sensitive adhesive on the bottom surface of each label contacts and adheres to one of the forms.

In many paper manufacturing operations, such as the printing and assembly of business forms, it is common practice to carry out the operation in a series of repetitive steps at spaced points along a continuously moving strip of paper and to then cut the continuous strip into the size required to form the pages of the business form. In particular, multi-part business forms are printed and collated in such a fashion and the collated continuous strips of paper are cut into the desired size after the final assembly thereof.

In this regard, the principal disadvantage of the conventional label air machine described above is that, in order to apply the transfer labels, business forms cannot be continuously passed through the machine but must essentially be indexed through the machine one at a time. The usual practice for applying transfer labels to a continuous strip of business forms is to fold the strip in zig-zag fashion along transverse lines of weakening formed in the paper and to then feed the stack of folded paper into the label air machine. Operation of the label air machine requires that each individual form in the stack of folded paper be indexed through the label air machine; i.e., the paper does not continuously move as it passes through the machine, rather, one segment of paper is pulled into the machine, the movement of paper momentarily stops while a label is applied, and then another segment of paper is indexed into the machine. It has become a common industry practice to feed stacks of folded paper into the machine instead of pulling the paper from a roll thereof because the first sheet in a stack can be glued or attached to the final sheet of the stack of paper being fed into the machine. This permits the label air machine to be run continuously. If paper was fed into the machine from a roll, the machine would have to be shut down when the end of a roll was reached so that the core of the old roll could be removed and a new roll installed on the machine.

A further limitation of the label air machine is that the machine is unable to accurately apply labels in the same position on identical business forms. The comparative position of labels blown onto identical business forms by the machine will often vary by about 1/16 of an inch. The variance in the positioning of labels precludes imprinting the entire surface of the label and, as a consequence, the material to be printed thereon will normally occupy an area substantially less than the surface area of the label to compensate for variance in label position. The inability of the label air machine to consistently place a label in the same position on identical business forms results in a substantial amount of unused and wasted label material.

The conventional label air machine is further limited in operation in that when a plurality of transfer labels or strips are attached side by side to a paper substrate, there must be a minimum distance of approximately two inches between any two labels. This particular limitation rules out the application of a pair of closely spaced labels to a paper substrate.

The printing of business forms is commonly carried out by feeding continuous strips of business forms through high-speed presses at the rate of thousands of copies per hour. Prior to the improved process described and claimed in my U.S. Pat. No. 4,379,573, a like process which permitted both the imprinting of a paper substrate and formation of a removable label on the substrate is a "one-pass" continuous high speed operation apparently had not been utilized. Instead, the conventional process comprised imprinting a continuous strip of paper substrate, folding the strip, running a stack of folded paper through a label air machine to attach the labels, refolding or rolling the continuous strip of labeled paper leaving the label air machine, and then collating, cutting or further imprinting the continuous strips as desired. This conventional process obviously entails repeated manual handling of the paper and the increased production costs associated therewith.

Even assuming that a conventional label air machine were able to be employed in an automated process, three to five percent of the business forms processed by the machine would not be usable because the applied labels would be bent, would be damaged, or would have failed to adhere to the paper when blown on. In addition, the bi-layered transfer labels employed generally have an average thickness of seven to eight thousandths of an inch. When large numbers of label forms are stacked, the resulting buildup of label thickness can, especially when a single label is applied to each form, cause the paper stack to list, making handling and storage of the paper awkward.

The prior art transfer tape—die cut label process and business form described in my U.S. Pat. No. 4,379,573 was developed to overcome some of the above-described problems associated with the conventional label air machine. This transfer tape—die cut label process permits a continuously moving paper substrate to be imprinted and provided with a removable label during a single pass through paper processing equipment. During the transfer tape—die cut process, the contact adhesive on a piece of transfer tape is pressed against the back of a business form to secure the tape to the form. A die cut label area is then made in the form above the transfer tape. The die cut label can be peeled off of the form. When the die cut label is peeled off of the form, the adhesive on the transfer tape "transfers" from the transfer tape to the back of the label so that the label can be adhered to an envelope or other desired surface. The transfer tape—die cut label process described and claimed in my U.S. Pat. No. 4,379,573 is advantageous because it permits a continuously moving paper substrate to be imprinted and provided with a removable label during a single pass through paper processing equipment, because it can add only a small amount of additional thickness to a business form so that the build-up of label thickness is minimized when forms having the transfer tape are processed, and because the process minimizes the number of defective and unusable business forms after paper substrates have been imprinted and provided with transfer tape and removable die cut label areas.

The transfer tape—die cut process does, however, have certain disadvantages. First, the cost of transfer tape is relatively expensive, about fifty cents per one thousand square inches. Second, the use of transfer tape inherently limits the type of adhesives which can be utilized because the tape requires adhesives which will separate from the tape and "transfer" to a second surface which is pressed against the adhesive. Third, the selection of transfer tape is limited. Only certain sizes of transfer tape are available. Fourth, transfer tape is difficult to use on business form substrates which are thin. Even though the adhesive from transfer tape which sticks to the back of a die cut business form label tends to "thicken" the label, light weight paper simply does not make particularly good labels because light weight paper readily tears and wrinkles.

Accordingly, it would be highly desirable to provide an improved removable label business form which would incorporate the advantages of the transfer tape—die cut process while significantly reducing cost, while permitting the use of a wide variety of adhesives, while providing a wide selection of materials which can be used in combination with a business form to produce a removable label, and while enabling light weight business forms to be provided with removable labels.

Therefore, it is a principal object of the invention to provide an improved business form having a label or labels removable therefrom.

Another object of the invention is to provide a method for imprinting and providing a removable label for a business form which allows a continuously moving paper substrate to be imprinted and provided with a removable label during a single pass through paper processing equipment.

A further object of the present invention is to provide a method for providing a paper sheet substrate with a removable label which reduces cost, which permits the use of a wide variety of adhesives, which enables a wide selection of convention, off-the-shelf, readily available materials to be used in combination with a business form to produce a removable label, and which enables business forms made from light weight paper to be provided with removable labels.

Still another object of the invention is to provide a method for imprinting and providing a paper sheet substrate with a removable label which results in a minimal number of defective and unusable business forms after the substrate has been imprinted and provided with removable label areas.

Yet another object of the invention is to provide a method for producing business forms which permits a removable label to be accurately placed in an identical position on each of a plurality of forms.

BRIEF DESCRIPTION OF THE DRAWINGS.

These and other, further and more specific objects and advantages of the invention will be apparent to those skilled in the art from the following detailed description thereof, taken in conjunction with the drawings, in which:

FIG. 1 is a perspective view of a business form provided with a removable label;

FIG. 2 is a partial perspective view of the business form of FIG. 1 illustrating a prior art removable label attached thereto;

FIG. 3 is a sectional view of the business form of FIG. 2 taken along section line 3—3 thereof;

FIG. 4 is a partial perspective view of the business form of FIG. 1 illustrating another prior art removable label attached thereto;

FIG. 5 is a sectional view of the business form of FIG. 4 taken along section line 5—5 thereof;

SUMMARY OF THE INVENTION

Figure 6:
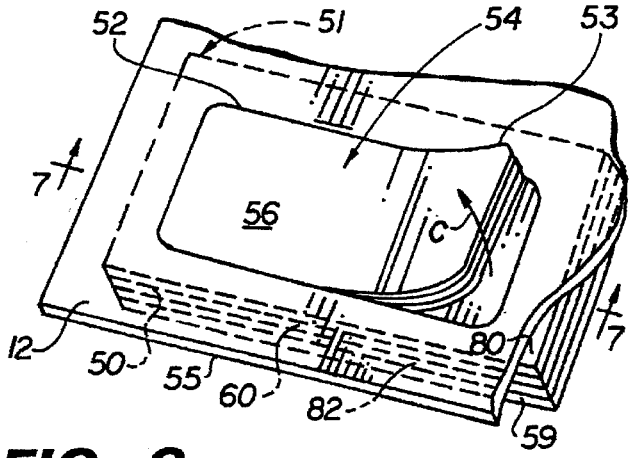
FIG. 6 is a section view of the business form of FIG. 1 provided with a removable label in accordance with one embodiment of the present invention.

Briefly, in accordance with the invention, I provide a business form having a die cut label area removable therefrom. The form includes a sheet of paper having a back side, an imprinted front side and an outer peripheral edge; and, at least one piece of label stock.

The label stock has an outer peripheral edge and includes a layer of face stock, a layer of liner material, and a first layer of adhesive intermediate the layer of face stock and the layer of liner material. The layer of adhesive adheres to the face stock and separates from the layer of liner material when the face stock is peeled away from the liner material.

A second layer of adhesive fixedly secures the label stock to a limited area on the back of the paper sheet such that the outer peripheral edge of the piece of label stock generally lies within the outer peripheral edge of the paper sheet.

A label area is die cut in the sheet of paper above the layer of liner material and has an outer peripheral edge. The outer peripheral edge of the die cut label generally lies within the outer peripheral edge of the label stock.

A label backing is die cut in the face stock of the label stock above the layer of liner material and has an outer peripheral edge coterminating with the outer peripheral edge of the label area.

A portion of the first layer of adhesive lying between the layer of liner material and the die cut label backing adheres to the label backing and separates from the layer of liner material when the label backing is peeled away from the layer of liner material.

A portion of the business form lies between the peripheral edge of the die cut label area and the peripheral. edge of the transfer tape and includes a first portion of the second layer of adhesive sandwiched between a section of the sheet of paper and a section of the layer of face stock of the label stock lying outside the outer peripheral edge of the label area.

A second portion of the second layer of adhesive lies between the label area and the label backing, and adheres the label area to the label backing when the label backing is peeled away from the liner material.

The label stock is sized such that the first portion of the second layer of adhesive in the portion of the business form between the peripheral edge of the die cut label area and the peripheral edges of the label stock is sufficient to maintain the portion of the layer of face stock lying outside the outer peripheral edge of the label area in position on the paper sheet when the label backing is peeled from the backing material of the label stock.

DESCRIPTION OF THE PREFERRED EMBODIMENTS

Turning now to the drawings, which describe the presently preferred embodiments of the invention for the purpose of illustrating the practice thereof and not by way of limitation of the scope of the invention, and in which like reference characters refer to corresponding elements throughout the several views, FIG. 1 illustrates a business form generally identified by reference character 11 and consisting of a paper substrate 12 having printed matter 13 and a removable label 14 on the face thereof.

As shown in FIGS. 2 and 3, in one prior art business form, removable label 14 normally consists of two layers 15, 16. The bottom surface 18 of layer 15 has a pressure sensitive adhesive contacting the upper face 17 of substrate 12. The upper surface 19 of layer 15 is provided with an adhesive which removably secures layer 16 thereto. When layer 16 is peeled from layer 15 in the direction of arrow A to form a label, adhesive on the lower surface 24 of layer 16 permits layer 16 to be affixed to another paper form. The combined thickness of layers 15 and 16 is approximately seven to eight thousandths of an inch.

A label 14 formed in substrate 12 in accordance with another prior art business form is illustrated in FIGS. 4 and 5. Upper surface 20 of layer 21 is provided with adhesive which transfers from layer 21 to the bottom surface 25 of substrate 12 when layer 21 is attached thereto. After layer 21 is adhesively secured to substrate 12 the substrate 12 is die cut along line 22 to form label 23 which is peelable from layer 21 in the direction of arrow B. Label 23 may, due to adhesive transferred thereto from layer 21, be secured to an ancillary piece of paper. Layer 21 has a thickness of approximately three thousandths of an inch.

Figure 8:
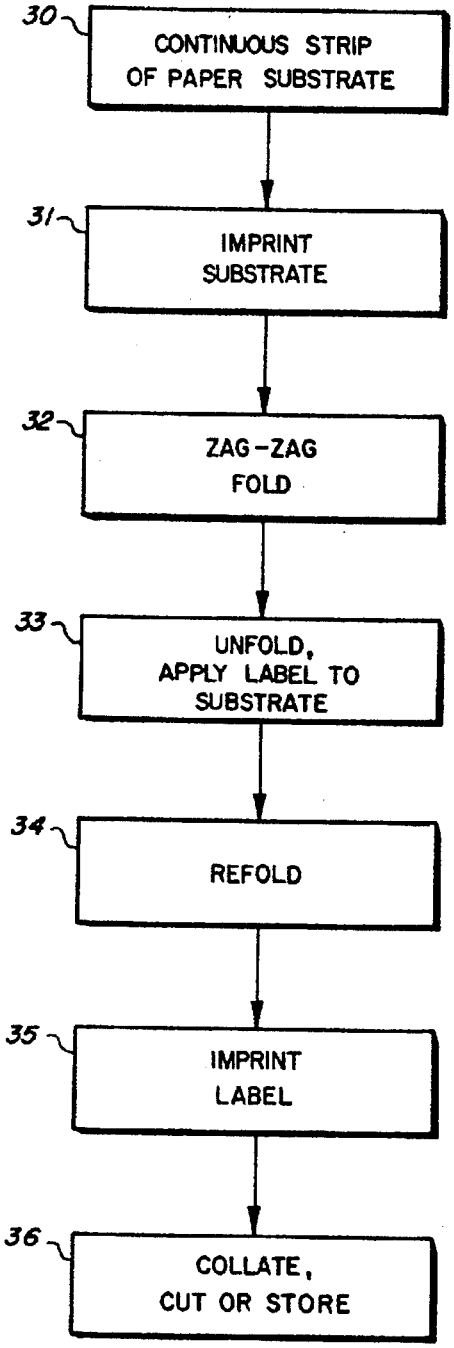
FIG. 8 (PRIOR ART)
FIG. 8 is a flow diagram illustrating a prior art method of producing the business form of FIGS. 1, 2, and 3.

A conventional prior art process for producing the business form of FIGS. 1, 2, 3 is illustrated by the flow chart of FIG. 8. A continuous strip of paper substrate 30 is imprinted with a business format 31 and folded 32 in zig-zag fashion along transverse lines of weakening formed therein. The business forms contained in the stack of folded paper are indexed one at a time through a label air machine which applies the labels 14 of FIGS. 2 and 3 to the paper substrate 12 of form 11. Labeled forms dispensed by the label air machine are refolded 34. The stack of refolded business forms is run through a press to imprint 35 data on removable labels 14. The finished business forms are collated with another strip of paper substrate or carbon paper, are cut, or are stored as desired. Application of labels 14 by the label air machine is a relatively slow process, and the necessity of folding a strip of continuous forms before and after processing by the label air machine creates a bottleneck in the overall process of producing business forms 11 having removable labels 14.

Figure 9:
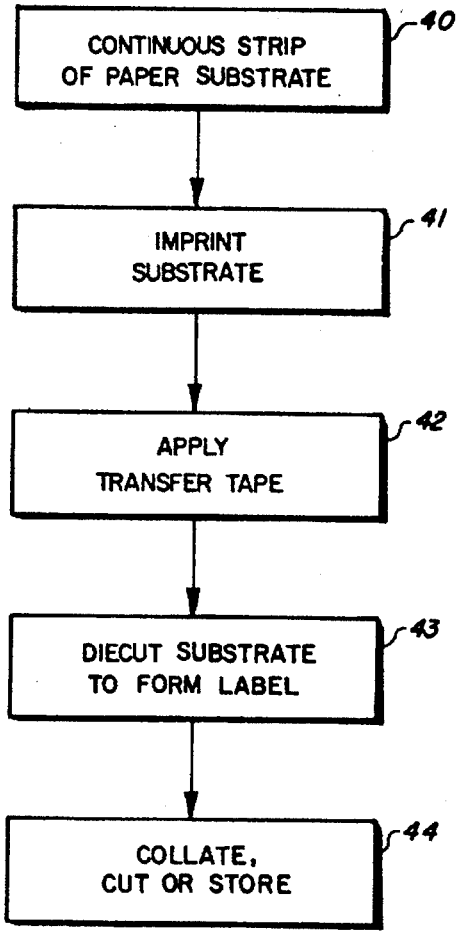
FIG. 9 (PRIOR ART)
FIG. 9 is a flow diagram illustrating a prior art method of producing the business form of FIGS. 1, 4, and 5.

The process illustrated in FIG. 9 allows paper substrate from a supply of individual sheets or of a continuous strip thereof to both be imprinted with a business format and be provided with removable labels during a single pass through paper processing apparatus. In the process of FIG. 9, paper substrate 40 from a continuous supply thereof is imprinted 41 with a business format. Transfer tape is adhesively applied 42 to the paper substrate 12 to form bi-layer areas along the substrate comprising an area of transfer tape adhesively secured to an equivalent adjacent area of the original paper substrate. One of the pair of layers is die cut 43 to form label area which is peelable from the adjacent layer. Since the steps of imprinting 41, die cutting 43 and applying transfer tape 42 can each be carried out on a rapidly moving sheet of paper, the entire process of imprinting and providing a removable label for a paper substrate is completed during a single pass of the substrate through high speed paper processing apparatus. The step of imprinting 41 the substrate may, of course, be performed after application of the transfer tape or after the substrate is die cut.

A variety of transfer tapes 21 may be applied to substrate 12 during the process shown in FIG. 9. In one embodiment of the process of FIG. 9, surface 20 of tape 21 is provided with an adhesive which adheres to surface 12 and separates from the upper surface 20 of tape 21 when label 23 is peeled off in the direction of arrow B (see FIG. 5). However, the lower surface 25 of substrate 12 can be provided with a smooth surface of hardened adhesive which becomes tacky on contact with water. In this case, the adhesive on surface 20 continues to adhere to tape 21 when label 23 is removed. In some instances it is also be desirable for the surface 20 of transfer tape 21 to have a self-contained carbonless coating which reproduces information imprinted on the upper surface of label 23.

Removable labels similar to the labels pictured in FIGS. 2 and 3 can be attached by a label air machine to the same position on a plurality of business forms only to within a variance of about 1/16 of an inch. In contrast, when the process of FIG. 9 is utilized, labels can be die cut at an identical position on a plurality of forms with a variance in position which is substantially less. The improved accuracy of label placement inherent in die cutting the label allows a larger area of the label surface to be imprinted, reducing the amount of transfer tape material required.

A further benefit of the process of FIG. 9 is that when layer 12 is die cut to form removable label area, if a plurality of labels are cut in layer 12, the labels may be closely adjacent one another. There is no minimum spacing requirement similar to that earlier described in the label air machine. In addition, the number of defective and unusable business forms produced during the process of FIG. 9 is less than the accepted industry standard of 3% to 5% of total production for the label air machine.

Figure 7:
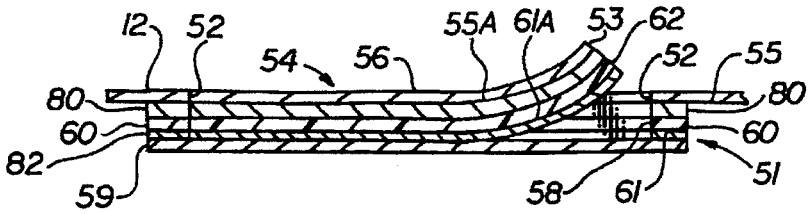
FIG. 7 is a sectional view of the business form of FIG. 6 taken along section line 7—7 thereof.

A removable label 54 formed in substrate 12 in accordance with one embodiment of the invention is illustrated in FIGS. 6 and 7. Conventional label stock 51 is utilized in conjunction with substrate 12 to form label 54. In FIGS. 6 and 7, stock 51 is rectangular and includes a face layer 60 which ordinarily would, in use, be imprinted with alphanumeric characters or other desired inscriptions. A layer of contact adhesive 82 is applied and is affixed to the entire bottom surface 61 of layer 60. A layer 59 of liner material covers bottom surface 61 and the contact adhesive 82 is secured thereto such that layer 60 can be peeled apart from liner layer 59 with the contact adhesive still adhering to bottom surface 61. In normal use, the contact adhesive is used to secure the face layer 60 to another piece of paper or to another desired surface after layer 60 is peeled apart from liner layer 59.

If desired, label stock 51 can include face layer 60 and liner layer 59 and can, instead of the contact adhesive affixed to surface 61, include an adhesive on upper surface 57 of liner layer 59 which transfers from liner layer 59 to surface 61 of face layer 60 when layer 60 is peeled apart from liner layer 59.

The conventional label stock 51 is attached to the bottom surface 55 of substrate 12 with adhesive layer 80 which secures upper surface 50 of layer 60 to the bottom surface 55 of substrate 12 when layer 60 is pressed against surface 55 in the manner shown in FIGS. 6 and 7. The layer of adhesive 80 is normally between surface 55 and the upper surface 50 of face layer 60 and is coextensive with layer 60. The adhesive layer 80 preferably, although not necessarily, permanently affixes layer 60 to bottom surface 55.

After layer 60 is adhesively permanently secured to substrate 12, the substrate 12 and layer 60 are die cut through along continuous peripheral surfaces 52 and 58, respectively, to form a bi-layer label 54 which is peelable from layer 59 and form 11 in the direction of arrow C. Label 54 includes rectangular layer 56 cut from substrate 12 and rectangular backing layer 62 cut from the face layer 60 of label stock 51. Layer 56 has a bottom surface 55A which comprises a portion of the total area of the bottom surface 55 of substrate 12. Layer 56 also has an upper surface having left hand portion 56A and right hand portion 56B. Alphanumeric characters 75 (i.e., "STEWART 0532017") are imprinted or formed on portion 56A, and alphanumeric characters 76 ("AZ") are formed on portion 56B. A line of weakening, for example a perforated line, 63 is formed through layer 56 to facilitate the folding of label 54 in the manner illustrated in FIGS. 11 to 13. Alphanumeric characters 75 and 76 or other characters, pictorial information, or other information or designs can be imprinted on substrate 12 by a laser printer, a stamp, or any other imprinting means in black ink or in any color ink or inks prior to or after substrate 12 is die cut through along surface 52, and prior to layer 56 being peeled from layer 59 and removed from substrate 12.

Backing layer 62 has a bottom surface 61A which comprises a portion of the total area of the bottom surface 61 of the face layer 60. Layer 56 is permanently secured to backing layer 62 by a portion of the adhesive layer 80 which, as noted above, secures layer 60 to the bottom of substrate 12. Liner layer 59 ordinarily is not cut through, at least not completely through such that a tri-layer label can fall free from the business form 11. The tri-layer label would include layers 56, 62, and a portion of liner layer 59 which has a peripheral edge coterminating with the peripheral edges of layers 56 and 62 can. The peripheral edge of layer 56 normally coterminates with the peripheral edge of backing layer 62 and layers 56 and 62 are of equal shape and dimension. It is, however, possible that the peripheral edge of layer 62 could lie within the peripheral edge of layer 56.

After label 54 is peeled off of liner layer 59 and separated from business form 11, label 54 can, due to adhesive carried on the bottom 61A of layer 62, be secured to an ancillary piece of paper, a shipping container, or any other desired article. When label 54 is peeled off of liner layer 59, liner layer 59 and remaining portions of face layer 60 remain affixed to substrate 12 in the manner illustrated in FIGS. 4 and 5.

Figure 11:
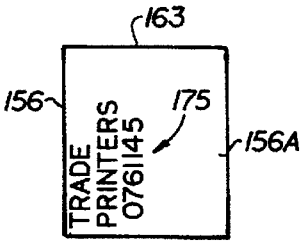
FIG. 11 is a side view illustrating a card produced by folding in half the label of FIGS. 6 and 7.
Figure 12:
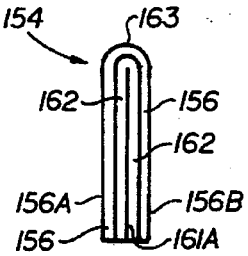
FIG. 12 is a front view further illustrating the card of FIG. 11.
Figure 13:
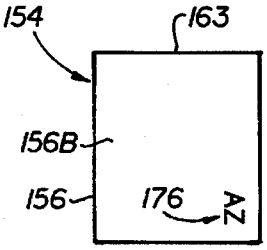
FIG. 13 is a side view further illustrating the card of FIG. 12.

After label 54 is peeled off of liner layer 59 and separated from business form 11, label 54 can also, due to the adhesive carried on the bottom 61A of layer 62, be folded in half along line of weakening 63 in the directions indicated by arrows D and E in FIG. 12 to take on the configuration shown in FIG. 12. In FIGS. 11 to 13, the adhesive on the bottom 61A of layer 62 secures both halves of label 54 together when the bottom 61A is folded along line of weakening 63 such that each half of bottom 61A is pressed against the other half to take on the configuration shown in FIGS. 11 to 13.

The card or laminate illustrated in FIGS. 11 to 13 is advantageous because the alphanumeric characters 75, 76 or other information or data or illustrations appearing on the "front" surface 56A and "back" surface 56B of the card can be pre-printed or otherwise formed on a business form or substrate 12 prior to peeling label 54 from the form in the manner illustrated in FIG. 6. Consequently, a card or other laminate can be formed without requiring a first printing pass to imprint the front of the card and requiring a second printing pass to imprint the back of the card.

The thickness of face layer 60 of the label stock 51 can vary as desired, as can the shape and dimension of label stock 51. Stock 51 can be rectangular, square, circular, or any other shape and dimension. The thickness of backing layer 62 (and face stock 60) can vary widely because of the wide availability of differing types of label stock. A particular virtue of the method of the invention is that it permits a business form 11 to be produced utilizing a paper substrate 12 having an unusually light weight of ten to twelve pounds. This is possible because the layer 62 increases the thickness, weight, and strength of the label 54 produced in conjunction with substrate 12. Being able to utilize a light weight substrate 12 in the production of the business form 11 of the invention is important because it can significantly reduce the cost of the substrate used to produce form 11. This cost savings is further enhanced by the fact that label stock only costs about 30 cents per 1000 square inches, compared to about 50 cents per 1000 square inches for transfer tape. Further, the adhesive used to affix surface 50 to the back of substrate 12 can be any of a wide variety adhesives and is not restricted to the specialty adhesives associated with the production of transfer tape.

Figure 10:
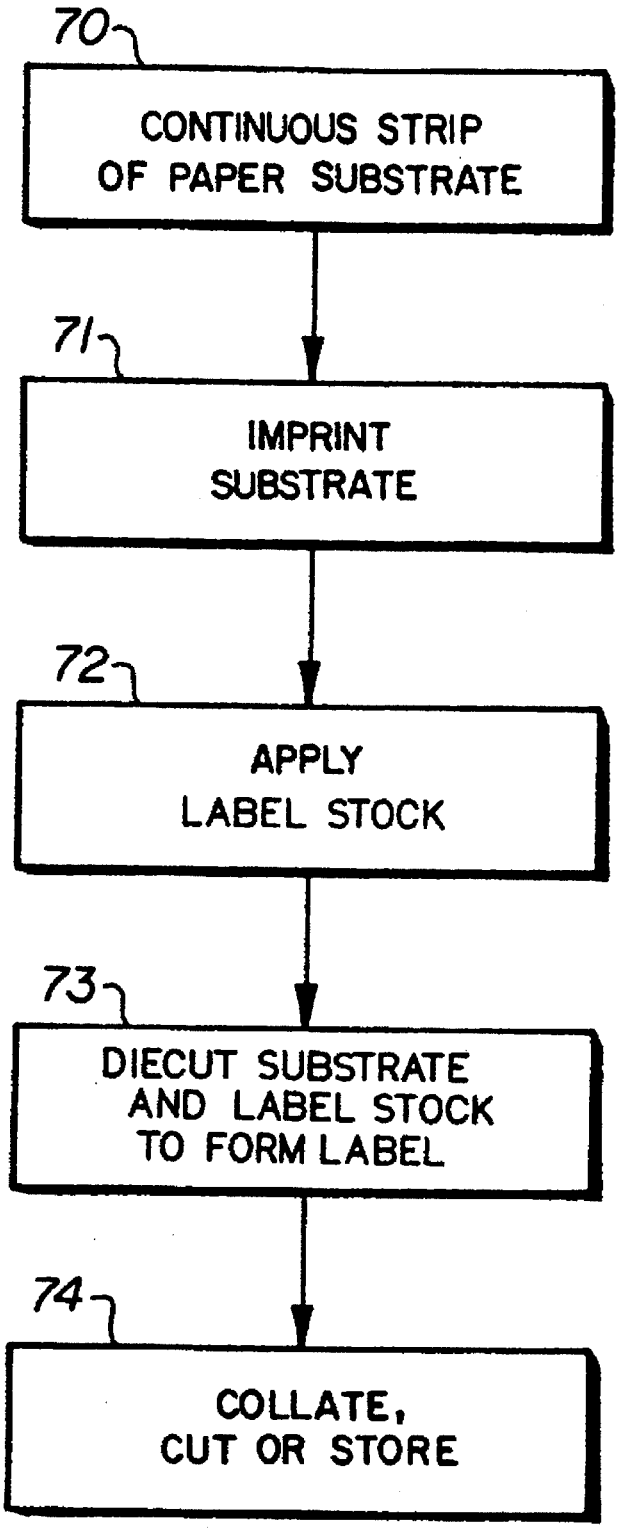
FIG. 10 is a flow diagram illustrating a process for producing a business form having a removable label in accordance with the instant invention.

The process utilized to produce the business form label of FIGS. 6 and 7 is illustrated in FIG. 10. In the process of FIG. 10, paper substrate 70 from a continuous supply thereof is imprinted 71 with a business format. Label stock is adhesively applied 72 to an equivalent adjacent area of the bottom of paper substrate 12 to form a tri-layer area on the substrate. A portion of the substrate adjacent the label stock comprises the first layer. The label stock comprises second and third layers, a face layer and a liner layer. The face layer (second layer) is sandwiched between the substrate layer (first layer) and the liner layer (third layer). The substrate layer and face layers are die cut 73 to form label area which is peelable from the adjacent liner layer. Since the steps of imprinting 71, applying label stock 72, and die cutting 73 can each be carried out on a rapidly moving sheet of paper, the entire process of imprinting and providing a removable label for a paper substrate is completed during a single pass of the substrate through high speed paper processing apparatus. The step of imprinting 71 the substrate may, of course, be performed after application of the label stock or after the substrate and face layer of the label stock are die cut. In some instances it is desirable for the surface of liner layer 59 to have a self-contained carbonless image which reproduces information imprinted on the upper surface of layer 56 before the label area 54 is peeled off of liner layer 59.

The lower surface 61 (and consequently surface 61A) of face layer 60 can be provided with a smooth surface of hardened adhesive which becomes tacky on contact with water. In this case, surface 57 is provided with another layer of adhesive which continues to adhere to surface 57 and liner layer 59 when label 54 is removed from business form 11 by peeling label 54 off of liner layer 59. Label 54 includes peripheral edge 53.

Figure 14:
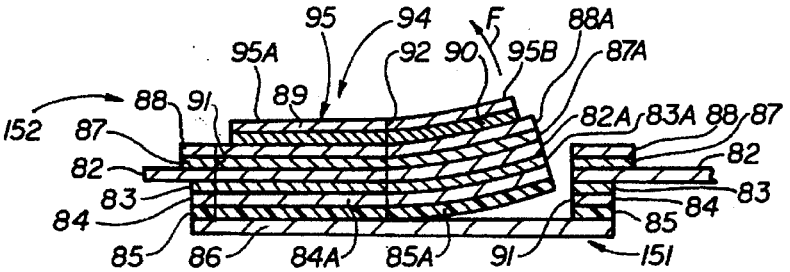
FIG. 14 is a side section view illustrating an alternate embodiment of the invention.

Another embodiment of the invention is illustrated in FIGS. 14 to 17. A removable label 94 is formed in substrate or business form 82. Conventional label stock 151 is utilized in conjunction with substrate 82 to form label 94. Label stock 151 includes a face layer 84 of label material, a layer 85 of contact adhesive, and a backing layer 86. The layer 85 of contact adhesive permits layer 84 to be peeled apart from layer 86. In FIG. 14, label stock 151 is rectangular and includes a face layer 84 which ordinarily would, in use, be imprinted with alphanumeric characters or other desired inscriptions. In normal use of label stock 151, contact adhesive 85 adheres to layer 84 when layer 84 is peeled apart from backing layer 86 and, adhesive 85 is used to secure the face layer 84 to another piece of paper or to another desired surface after layer 84 and adhesive 85 are peeled apart from backing layer 86.

The conventional label stock 151 is attached to the bottom surface of substrate 82 with adhesive 83 which secures the upper surface of layer 60 to the bottom surface of substrate 82 when layer 84 is pressed against surface 55 in the manner shown in FIG. 14. The layer of adhesive 83 is normally between substrate 82 and face layer 84 and is coextensive with layer 84. The adhesive preferably, although not necessarily, permanently affixes layer 83 to layer 82.

In addition to label stock 151, label stock 152 is utilized in conjunction with substrate 82 to form label 94. Label stock 152 includes a face layer 89 of label material, a layer 90 of contact adhesive, and a backing layer 88. The layer 90 of contact adhesive permits layer 89 to be peeled apart from layer 88. In FIG. 14, label stock 151 is rectangular and includes a surface 95 on face layer 89 which ordinarily would, in use, be imprinted with alphanumeric characters or other desired inscriptions. In normal use of label stock 152, contact adhesive 90 adheres to layer 88 when layer 89 is peeled apart from backing layer 88 and, adhesive 90 is used to secure the face layer 89 to another piece of paper or to another desired surface after layer 89 and adhesive 90 are peeled apart from backing layer 88.

The conventional label stock 152 is attached to the top surface of substrate 82 with adhesive 87 which secures the upper surface of layer 82 to the bottom surface of substrate 88 when layer 88 is pressed against layer 82 in the manner shown in FIG. 14. The layer of adhesive 87 is normally between substrate 82 and backing layer 88 and is coextensive with layer 88. The adhesive preferably, although not necessarily, permanently affixes layer 88 to layer 82.

After layers 88 and 84 are adhesively permanently secured to substrate 82 by adhesive layers 87 and 83 in the manner shown in FIG. 14, the substrate 82, layers 84 and 88, and adhesive layers 83, 85, 87 are die cut through along continuous peripheral surface 91, respectively, to form a multi-layer label 94 which is peelable from layer 86 and form 11 in the direction of arrow F. Layer 86 ordinarily is not die cut through.

Label 94 includes rectangular layer 89, rectangular adhesive layer 90, rectangular layer 88A cut from layer 88, rectangular layer 82A cut from substrate 82, rectangular adhesive layer 83A cut from adhesive layer 83, rectangular layer 84A cut from layer 84, and rectangular adhesive layer 85A cut from the adhesive layer 85. Layer 89 also has an upper surface 95 having left hand portion 95A and right hand portion 95B. Alphanumeric characters 97 (i.e., "BOONE 0240183") are imprinted or formed on portion 95A, and alphanumeric characters 96 ("AZ") are formed on portion 95B. A line of weakening, for example a perforated line, 92 is formed through layers 89, 90, 88A, 87A, 82A, 83A, 84A, 85A to facilitate the folding of label 94 in the manner illustrated in FIGS. 15 to 17.

After label 94 is peeled off of backing layer 86 and separated from business form or substrate 82 11, label 54 can, due to adhesive carried on the bottom 61A of layer 62, be secured to an ancillary piece of paper, a shipping container, or any other desired article. When label 54 is peeled off of liner layer 59, liner layer 59 and remaining portions of face layer 60 remain affixed to substrate 12 in the manner illustrated in FIGS. 4 and 5.

Figure 15:
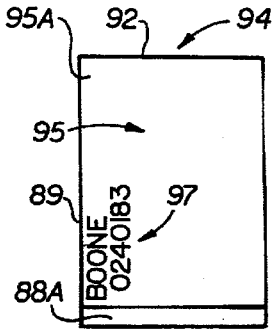
FIG. 15 is a side view illustrating a card produced by folding in half the label of FIG. 14.
Figure 16:
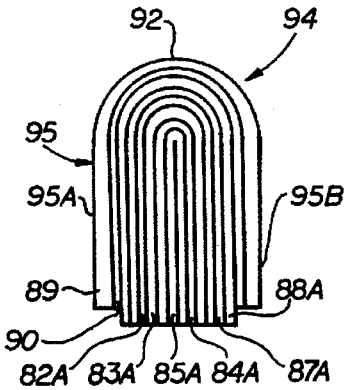
FIG. 16 is a front view further illustrating the card of FIG. 15.
Figure 17:
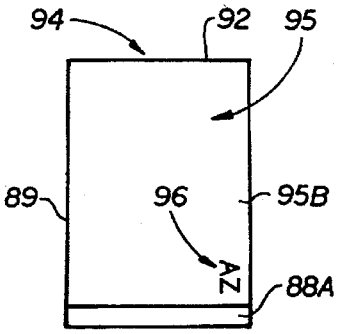
FIG. 17 is a side view further illustrating the card of FIG. 16.

After label 54 is peeled off of liner layer 59 and separated from business form 11, label 94 can also, due to the adhesive layer 85A carried on the bottom of layer 84A, be folded in half along line of weakening 92 into the configuration shown in FIGS. 15, 16, 17. In FIGS. 11 to 13, the adhesive layers 85A on the bottom of layer 84A secures both halves of label 94 together when the label 94 is folded along line of weakening 92 such that each half of label 94A is pressed against the other half to take on the configuration shown in FIGS. 15 to 17.

The card or laminate illustrated in FIGS. 15 to 17 is advantageous because the alphanumeric characters 97, 96 or other information or data or illustrations appearing on the "front" surface 95A and "back" surface 95B of the card can be pre-printed or otherwise formed on surface 95 of layer 89 prior to attaching label material 152 to substrate 82 and peeling label 54 from the substrate 82 in the manner illustrated in FIG. 14. Consequently, a card or other laminate can be formed without requiring a first printing pass to imprint the front of the card and requiring a second printing pass to imprint the back of the card.

Figure 18:
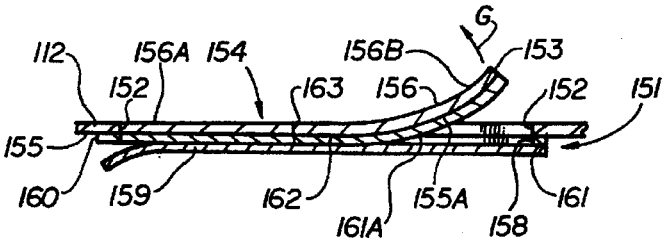
FIG. 18 is a side section view illustrating another embodiment of the invention.

A removable label 154 formed in substrate or business form 112 in accordance with one embodiment of the invention is illustrated in FIG. 18. Transfer tape 151 is utilized in conjunction with substrate 112 to form label 154. In FIG. 18, tape 151 is rectangular and includes an contact adhesive layer 160 and backing layer 159.

Adhesive layer 160 secures transfer tape 151 to the bottom surface 155 of substrate 112 when tape 151 is pressed against surface 155 in the manner shown in FIG. 18. After tape 151 is adhesively secured to substrate 112, the substrate 112 and layer 160 are die cut through along continuous peripheral surfaces 152 and 158, respectively, to form a bi-layer label 154 which is peelable from layer 159 and form 112 in the direction of arrow G. Label 154 includes rectangular layer 156 cut from substrate 112 and rectangular adhesive backing layer 162 cut from the adhesive layer 160 of label stock 151. Layer 156 has a bottom surface 155A which comprises a portion of the total area of the bottom surface 155 of substrate 112. Layer 156 also has an upper surface having left hand portion 156A and right hand portion 156B. Alphanumeric characters 175 (i.e., "TRADE PRINTERS 0761145") are imprinted or formed on portion 156A, and alphanumeric characters 176 ("AZ") are formed on portion 156B. A line of weakening, for example a perforated line, 163 is formed through layers 156 and 162 to facilitate the folding of label 154 in the manner illustrated in FIGS. 19 to 21.

Adhesive layer 162 has a bottom surface 161A which comprises a portion of the total area of the bottom surface 161 of the layer 160. Layer 156 is secured to layer 162. Backing layer 159 ordinarily is not cut through.

After label 154 is peeled off of backing layer 159 and separated from substrate or business form 112, label 154 can, due to adhesive layer 162, be secured to an ancillary piece of paper, a shipping container, or any other desired article. When label 154 is peeled off of backing layer 59, backing layer 159 and remaining portions of adhesive layer 160 remain affixed to substrate 112 in the manner illustrated in FIG. 18.

Figure 19:
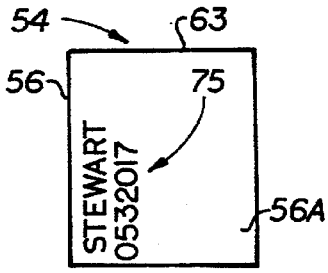
FIG. 19 is a side view illustrating a card produced by folding in half the label of FIG. 18.
Figure 20:
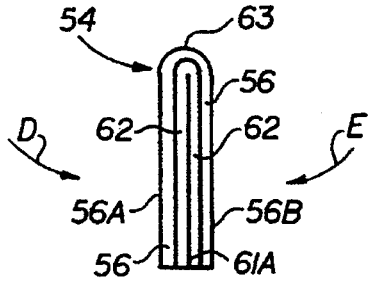
FIG. 20 is a front view further illustrating the card of FIG. 19.
Figure 21:
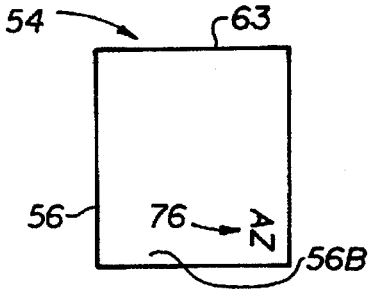
FIG. 21 is a side view further illustrating the card of FIG. 20.

After label 154 is peeled off of backing layer 159 and separated from substrate 112, label 154 can also, due to the adhesive layer 162, be folded in half along line of weakening 163 into the configuration shown in FIGS. 19 to 21. In FIGS. 19 to 21, the adhesive layer 162 on the bottom of layer 156 secures both halves of label 154 together when the label 154 is folded along line of weakening 163 such that each half of layer 162 is pressed against the other half to take on the configuration shown in FIGS. 19 to 21.

The card or laminate illustrated in FIGS. 19 to 21 is advantageous because the alphanumeric characters 175, 176 or other information or data or illustrations appearing on the "front" surface 156A and "back" surface 156B of the card can be pre-printed or otherwise formed on a business form or substrate 112 prior to peeling label 154 from the form in the manner illustrated in FIG. 18. Consequently, a card or other laminate can be formed without requiring a first printing pass to imprint the front of the card and requiring a second printing pass to imprint the back of the card.

The thickness of the layers of label stock, adhesive, and/or substrates or business forms utilized in the practice of the invention can vary as desired, as can the shape and dimension of the layers of label stock, the adhesive(s), and/or the business form(s).

The lines of weakening 63, 92, 163 can consist of perforations extending through one or more layers of a label 54, 94, 154, can be dashed or solid lines simply imprinted or marks on the surface of a label layer 56, 89, or 156, or can be any other means for indicating the line along which a label 54, 94, 154 is to be folded into a card.

As used herein, the term paper refers to paper produced from wood, cloth, or other materials and refers to any sheet material, including plastic, which can be inscribed or imprinted or serve as a layer of material in the business form of the invention.

As used herein, the term adhesive refers to glue, cement, electrostatic adhesion, or any other material used to adhere one layer of paper to another layer of paper. The adhesive may completely or partially cover a layer of material.

Having described my invention in such terms as to enable those skilled in the art to understand and practice it, and having described the presently preferred embodiments thereof, I claim:

1. A business form having a die cut label laminate removable therefrom and foldable to form a card, said form including (a) a sheet of paper having a back side, a front side, and an outer peripheral edge;

(b) at least one piece of label stock having an outer peripheral edge and including a layer of face stock, a layer of liner material, and a first layer of adhesive intermediate said layer of face stock and said layer of liner material, said layer of adhesive adhering to said face stock and separating from said layer of liner material when said face stock is peeled away from said layer of liner material, (c) a second layer of adhesive securing said label stock to a limited area on said back side of said paper sheet such that said outer peripheral edge of said piece of label stock generally lies within said outer peripheral edge of said paper sheet;

(d) a label area die cut in said sheet of paper above said layer of liner material and having (i) an outer peripheral edge, said outer peripheral edge of said label area generally lying within said outer peripheral edge of said label stock, (ii) a first surface, and (iii) a second surface;

(e) a label backing die cut in said face stock of said label stock above said layer of liner material and having an outer peripheral edge coterminating with said outer peripheral edge of said label area such that (i) a portion of said first layer of adhesive lies between said layer of liner material and said label backing and adheres to said label backing and separates from said layer of liner material when said label area and said label backing are peeled away from said layer of liner material, (ii) a portion of said business form lies between said peripheral edge of said die cut label area and said peripheral edge of said label stock and includes a first portion of said second layer of adhesive sandwiched between a section of said sheet of paper and a section of said layer of face stock of said label stock lying outside said outer peripheral edge of said label area, and (iii) a second portion of said second layer of adhesive lies between said label area and said label backing, and adheres said label area to said label backing when said label backing and said label area are peeled away from said layer of liner material, said label stock being sized such that said first portion of said second layer of adhesive in said portion of said business form between said peripheral edge of said label area and said peripheral edge of said label stock is sufficient to maintain said section of said layer of face stock lying outside said outer peripheral edge of said label area in position on said paper sheet when said label backing is peeled from said layer of liner material of said label stock; and, said die cut label laminate (i) including said label area, said label backing, said portion of of said first layer adhesive, and said second portion of said second layer of adhesive, and (ii) after being peeled from said layer of liner material of said label stock, being foldable upon itself to form said card such that said first surface comprises said front of said card, said second surface comprises said back of said card, and said portion of said first layer of adhesive secures said die cut label laminate in a folded orientation.

2. The business form of claim 1, including a line of weakening formed in said label area to indicate where said die cut label laminate is folded to form said card.

3. A business form having a die cut label laminate removable said reform and foldable to form a card, said form including (a) a sheet of paper having a back side, a front side, and an outer peripheral edge;

(b) at least one piece of transfer tape stock having an outer peripheral edge and including a layer of liner material and a layer of contact adhesive removably attached to said layer of liner material and attached to said back side of said sheet of paper, said layer of adhesive (i) adhering to and being separable from said layer of liner material when said sheet of paper is peeled away from said layer of liner material, (ii) fixedly securing said liner material to a limited area on said back side of said paper sheet such that said outer peripheral edge of said transfer tape stock generally lies within said outer peripheral edge of said paper sheet;

(d) a label area die cut in said sheet of paper above said layer of liner material and having (i) an outer peripheral edge, said outer peripheral edge of said label area generally lying within said outer peripheral edge of said transfer tape stock, (ii) a first surface, (iii) a second surface, and, (iv) a line of weakening; and, (e) a label backing die cut in said layer of adhesive of said transfer tape stock above said layer of liner material and having an outer peripheral edge coterminating at least in part with said outer peripheral edge of said label area such that (i) a first portion of said layer of adhesive lies between said layer of liner material and said label area and adheres to said label area and separates from said layer of liner material when said label area is peeled away from said layer off liner material, (ii) an intermediate portion of said business form lies between said outer peripheral edge of said label area and said outer peripheral edge of said transfer tape stock, and (iii) a second portion of said layer of adhesive is sandwiched between said intermediate portion of said sheet of paper and a section of said transfer tape stock lying outside of said outer peripheral edge of said label area, and said transfer tape stock being sized such that said second portion of said layer of adhesive is sufficient to maintain said section of said transfer tape stock lying outside said outer peripheral edge of said label area in position on said paper sheet when said label area is peeled from said layer of liner material of said transfer tape stock; and, said die cut label laminate (i) including said label area and said first portion of said layer of adhesive, and (ii) after being peeled from said layer of liner material of said transfer tape stock, being foldable along said line of weakening and upon itself to form said card such that said first surface comprises said front of said card, said second surface comprises said back of said card, and said first portion of said layer of adhesive secures said die cut label laminate in a folded orientation.

* * * * *